US006048058A

United States Patent [19]

Kasamoto et al.

[11] Patent Number: 6,048,058

[45] **Date of Patent: *Apr. 11, 2000**

[54] INK JET HEAD, INK JET CARTRIDGE INCORPORATING INK JET, AND INK JET APPARATUS INCORPORATING CARTRIDGE

[75] Inventors: Masami Kasamoto, Ayase; Hiroshi Sugitani, Machida; Yasuroh Kashima, Yokohama; Kazuaki Masuda, Kawasaki; Tsuyoshi Orikasa, Kasukabe; Hiroyuki Ishinaga, Tokyo; Makiko Kimura, Sagamihara; Seiichiro Karita; Jun Kawai, both of Yokohama; Teruo Arashima, Kawasaki; Yuji Kamiyama, Fujisawa, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/834,309

[22] Filed: Apr. 15, 1997

Related U.S. Application Data

[63] Continuation of application No. 08/521,459, Aug. 30, 1995, abandoned, which is a continuation of application No. 08/136,703, Oct. 15, 1993, abandoned.

[30] Foreign Application Priority Data

Oct. 16, 1992 [JP] Japan ..... 4-279047

[51] Int. Cl.[7] ..... B41J 2/055

[52] U.S. Cl. ..... 347/94; 347/13

[58] Field of Search ..... 347/12, 13, 42, 347/65, 94

[56] References Cited

U.S. PATENT DOCUMENTS

| | | | |
|---|---|---|---|
| 4,334,234 | 6/1982 | Shirato et al. | 347/65 |
| 4,412,224 | 10/1983 | Sugitani . | |

(List continued on next page.)

FOREIGN PATENT DOCUMENTS

| | | | |
|---|---|---|---|
| 0440500 | 8/1991 | European Pat. Off. . | |
| 0461935 | 12/1991 | European Pat. Off. . | |
| 56-136371 | 10/1981 | Japan . | |
| 59-199252 | 11/1984 | Japan . | |
| 210353 | 8/1989 | Japan | 347/65 |
| 3-234628 | 10/1991 | Japan . | |
| 276449 | 10/1992 | Japan | 347/94 |

*Primary Examiner*—N. Le
*Assistant Examiner*—Anh T. N. Vo
*Attorney, Agent, or Firm*—Fitzpatrick, Cella, Harper & Scinto

[57] ABSTRACT

An ink jet head includes a plurality of ejection orifices for ejecting ink; a common liquid chamber for storing temporarily the ink to be supplied to each of the ejection orifices; a plurality of ink passages, being separated by liquid passage walls, and each of which connects one of the ejection orifices to the common liquid chamber; and a plurality of energy generating elements provided one for one in each of the ink passages for generating energy to eject the ink from each of the ejection orifices; wherein the ejection orifices are grouped into a plurality of control blocks comprising a predetermined number of the ejection orifices in sequence so that the energy generating elements are driven by the block; and wherein walls are provided in the common liquid chamber, at the dividing lines between the control blocks, for impeding the ink movement in the liquid chamber, between the adjacent blocks.

25 Claims, 12 Drawing Sheets

U.S. PATENT DOCUMENTS 4,417,251 11/1983 Sugitani .
4,437,100 3/1984 Sugitani et al. .
4,450,455 5/1984 Sugitani et al. .
4,509,063 4/1985 Sugitani et al. .
4,521,787 6/1985 Yokota et al. .
4,558,333 12/1985 Sugitani et al. .
4,611,219 9/1986 Sugitani et al. .
4,666,823 5/1987 Yokota et al. ..... 430/320
4,860,033 8/1989 Shiozaki et al. .
4,875,059 10/1989 Masuda .
4,994,825 2/1991 Saito et al. .
5,021,809 6/1991 Abe et al. .
5,066,964 11/1991 Fukuda et al. .
5,095,321 3/1992 Saito et al. .
5,208,604 5/1993 Watanabe et al. .
5,262,802 11/1993 Karita et al. .

INK JET HEAD, INK JET CARTRIDGE INCORPORATING INK JET, AND INK JET APPARATUS INCORPORATING CARTRIDGE

This application is a continuation, of application Ser. No. 08/521,459, filed Aug. 30, 1995, now abandoned, which was a continuation of application Ser. No. 08/136,703, filed Oct. 15, 1993, now abandoned.

FIELD OF THE INVENTION AND RELATED ART

The present invention relates to an ink jet head comprising two or more liquid passages in which an element for generating ink ejection energy and a common liquid chamber connected to each of two or more liquid passages; an ink jet cartridge incorporating such an ink jet head; and an ink jet apparatus incorporating such an ink jet head.

More specifically, the present invention relates to an ink jet head incorporating a so-called block drive system, in which the aforementioned ejection energy generating elements are grouped into two or more control blocks comprising a predetermined number of adjacent energy generating elements so that they are driven by the block, to eject ink; an ink jet cartridge incorporating such an ink jet head; and an ink jet apparatus incorporating such an ink jet head.

FIG. 9 is a partial sectional view of a conventional ink jet head, being sectioned to expose the ejection orifices and their adjacent areas. As shown in FIG. 9, the ink jet head comprises two or more aligned ejection orifices 1101 and liquid passages 1108 which are separated by liquid passage walls. Each of the liquid passages 1108 is provided with an electro-thermal transducer 1102 which serves as an energy generating element to generate, in response to a driving signal, thermal energy for ejecting recording liquid (ink) from the ejection orifice. The electro-thermal transducer 1102 is integrally formed, together with an aluminum wiring for supplying the electro-thermal transducer with the driving signal, on a heater board of a silicon substrate, through film deposition technology. Each ink passage 1108 is connected to a common liquid chamber 1106 at the end opposite to the ejection orifice 1101, and this common liquid chamber 1106 is supplied with the ink by an ink container (unshown).

In the ink jet head constructed in the above described manner, the ink supplied from the ink container to the common liquid chamber 1106 is led to each of the ink passages, and as it reaches the ejection orifice 1101, it forms a meniscus. While the ink is held in the ink passage by the meniscus, the electro-thermal transducer 1102 is selectively driven to cause film boiling in the ink on the electro-thermal transducer 1102, whereby a bubble is developed within the ink passage 1108. As the bubble grows, the ink is ejected from the ejection orifice 1101.

In order to simplify the design of the circuit for driving selectively each of the electro-thermal transducers in the ink jet head comprising multiple ejection orifices 1101, a so-called block driving system is used, in which the multiple ejection orifices 1101 are grouped into two or more control blocks which are separately driven. For example, when an ink jet head has 64 ejection orifices 1101, the ejection orifices 1101 are grouped into eight blocks, that is, eight units to be separately driven, each comprising eight ejection orifices, and these blocks are sequentially driven.

FIG. 10 illustrates an example of the heater board circuit design for such a system. In this design, only eight wires suffice, simplifying the wiring.

However, when one of the blocks is driven, the meniscuses in the adjacent blocks are vibrated. FIG. 11 shows such vibration of the meniscuses formed at the ejection orifices of the block to be next driven (here, one of the adjacent blocks), immediately after one of the blocks is driven. The smaller the distance is to the ejection orifice from which the ink has been ejected, the larger the vibration is. While such vibration is present, the meniscus conditions are different among ejection orifices (the amount of the ink present on the ejection orifice side of the electro-thermal transducer is different), and therefore, when the ink is ejected while the vibration is present, the amount of ejected ink is different. As a result, the diameter of the dot formed on a recording medium becomes different, deteriorating picture quality.

Hence, in order to reduce the effects of the meniscus vibration, each block is driven with different timing. FIG. 12 shows the driving timing for each of the blocks. As shown in FIG. 12, COM 1 to COM 8 are sequentially driven, with intervals (delay) of tb ($\mu$ second), and while COM is on, a necessary seg is selectively turned on, whereby a desired letter or image is printed. Idealistically speaking, if the following block is driven after the meniscus vibration attenuate to zero, the ink can be stably ejected. However, such a procedure extremely slows down the printing speed. Therefore, the delay tb between the blocks is set up to be several microseconds larger than a pulse width of two to ten microseconds for the electro-thermal transducer 1102. More specifically, it is set to be 10 to 30 microseconds to suppress the printing shift between the blocks.

As an alternative means for reducing the effects of the meniscus vibration, it is possible to place a foam buffer (unshown) at the rear of each ink passage 1103 so that the meniscus vibration is absorbed by this foam buffer.

However, in the conventional ink jet head in which the effect of the meniscus vibration is reduced by differentiating the driving timing for each block, each block prints at a different location as shown in FIG. 14(A), which causes such a problem that an intended vertical line is printed with an angle. Because of the relation between such a problem and the aforementioned printing speed, the delay between the blocks is set to be 10 to 30 microseconds, which is not effective to reduce significantly the meniscus vibration.

More specifically, when the inter-block delay is set at 10 microseconds, the state of the meniscus of a following block $B_{n+1}$ 10 microseconds after a preceding block $B_n$ is driven is such that a small amount of the ink is already out of the ejection orifice 1102, as shown in FIG. 13(A), wherein the closer the ejection orifice 1102 is to the preceding block, the larger is the amount of the ink out of the ejection orifice. Therefore, if printing is carried out under this condition, the closer the ejection orifice in the following block is to the preceding block, the larger is the dot it produces, as shown in FIG. 14(B). On the other hand, when the inter-block delay is set at 30 microseconds, the state of the meniscus of the following block $B_{n+1}$ 30 microseconds after the preceding block $B_n$ is driven is such that the ink is receding from the ejection orifice 1102, as shown in FIG. 13(B), wherein the closer the ejection orifice is to the preceding block, the larger is the amount of the ink recession. Therefore, if printing is carried out under this condition, the closer the ejection orifice in the following block is to the preceding block, the smaller is the diameter of the dot it produces, as shown in FIG. 13(C).

In the ink jet head in which the meniscus vibration is absorbed by the foam buffer, the meniscus vibration is differently absorbed depending on the shape of the foam, which prevents the ink from being stably ejected. Further, the foam has a tendency to move while the head is in storage or a performance recovery operation is carried out. This movement of the foam sometimes causes foam concentration at the rear of the ink passage, preventing the ink ejection. In addition, it sometimes occurs that the foam is completely sucked out by the head performance recovery operation carried out after the head has been in storage. Therefore, the foam buffer cannot be deemed to be a reliable long term solution for absorbing the meniscus vibration.

SUMMARY OF THE INVENTION

Accordingly, the primary object of the present invention is to provide an ink jet head capable of stabilizing the meniscus condition so that excellent print can be produced, with the least amount of influence from the meniscus vibration; an ink jet cartridge incorporating such an ink jet head, and an ink jet apparatus incorporating such an ink jet head.

According to an aspect of the present invention, there is provided an ink jet head comprising: a plurality of ejection orifices for ejecting ink; a common liquid chamber for storing temporarily the ink to be supplied to each of the ejection orifices; a plurality of ink passages, being separated by liquid passage walls, and each of which connects one of the ejection orifices to the common liquid chamber; and a plurality of energy generating elements provided one for one in each of the ink passages for generating energy to eject the ink from each of the ejection orifices; wherein the ejection orifices are grouped into a plurality of control blocks comprising a predetermined number of the ejection orifices in sequence so that the energy generating elements are driven by the block; and wherein walls are provided in the common liquid chamber, at the dividing lines between the control blocks, for impeding the ink movement in the liquid chamber, between the adjacent blocks.

In the ink jet head structured in the above described manner in accordance with the present invention, the ejection orifices are grouped into two or more blocks comprising a predetermined number of adjacent ejection orifices, and these blocks are sequentially driven to eject the ink. When a preceding block is driven, the ink in the ink passages of the preceding block is vibrated as the ink is ejected from the ejection orifices. This vibration propagates into the ink passages of the adjacent blocks through the common liquid chamber. However, at least the liquid passage walls separating the adjacent two blocks are provided with an extension extending into the common liquid chamber; therefore, the propagation of the ink vibration into the adjacent blocks is impeded by this extension. As a result, the meniscus vibration is less likely to occur in the ejection orifices in the adjacent blocks, stabilizing the amount of the ink to be ejected when the following block is driven, whereby excellent print is produced in which the dot diameter is substantially the same.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
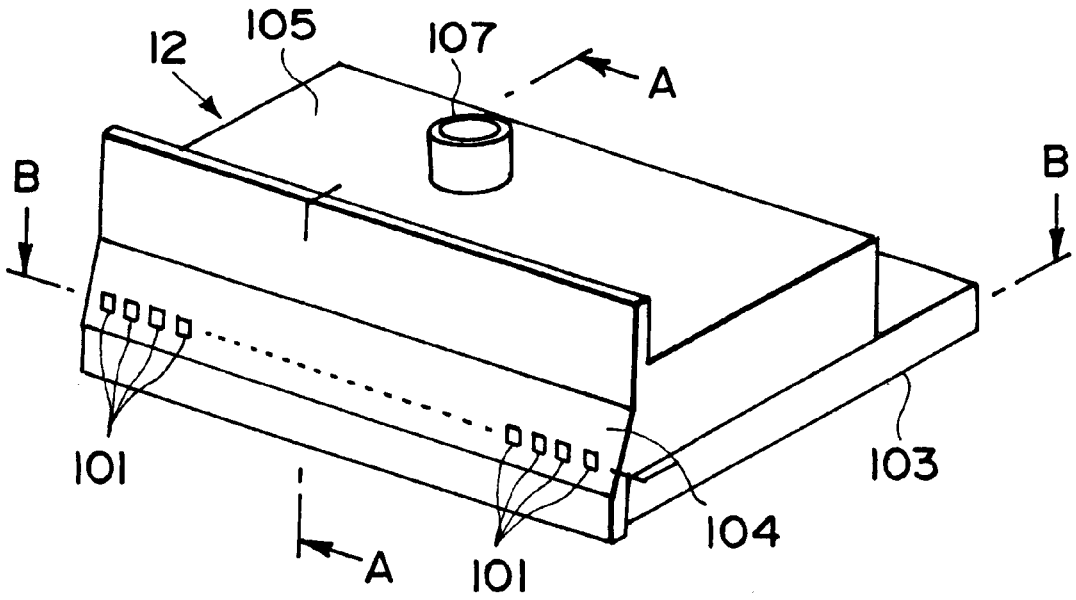
FIG. 1 is a schematic perspective view of a preferred embodiment of the ink jet head in accordance with the present invention.

Hereinafter, the embodiments of the present invention will be described referring to the drawings.

Figure 2:
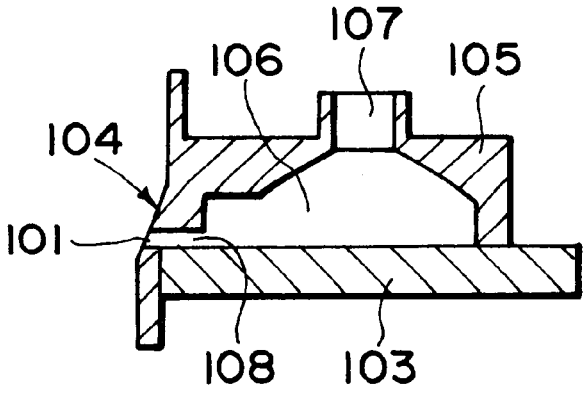
FIG. 2 is a sectional view of the ink jet head shown in FIG. 1, at a sectional line A—A.
Figure 3:
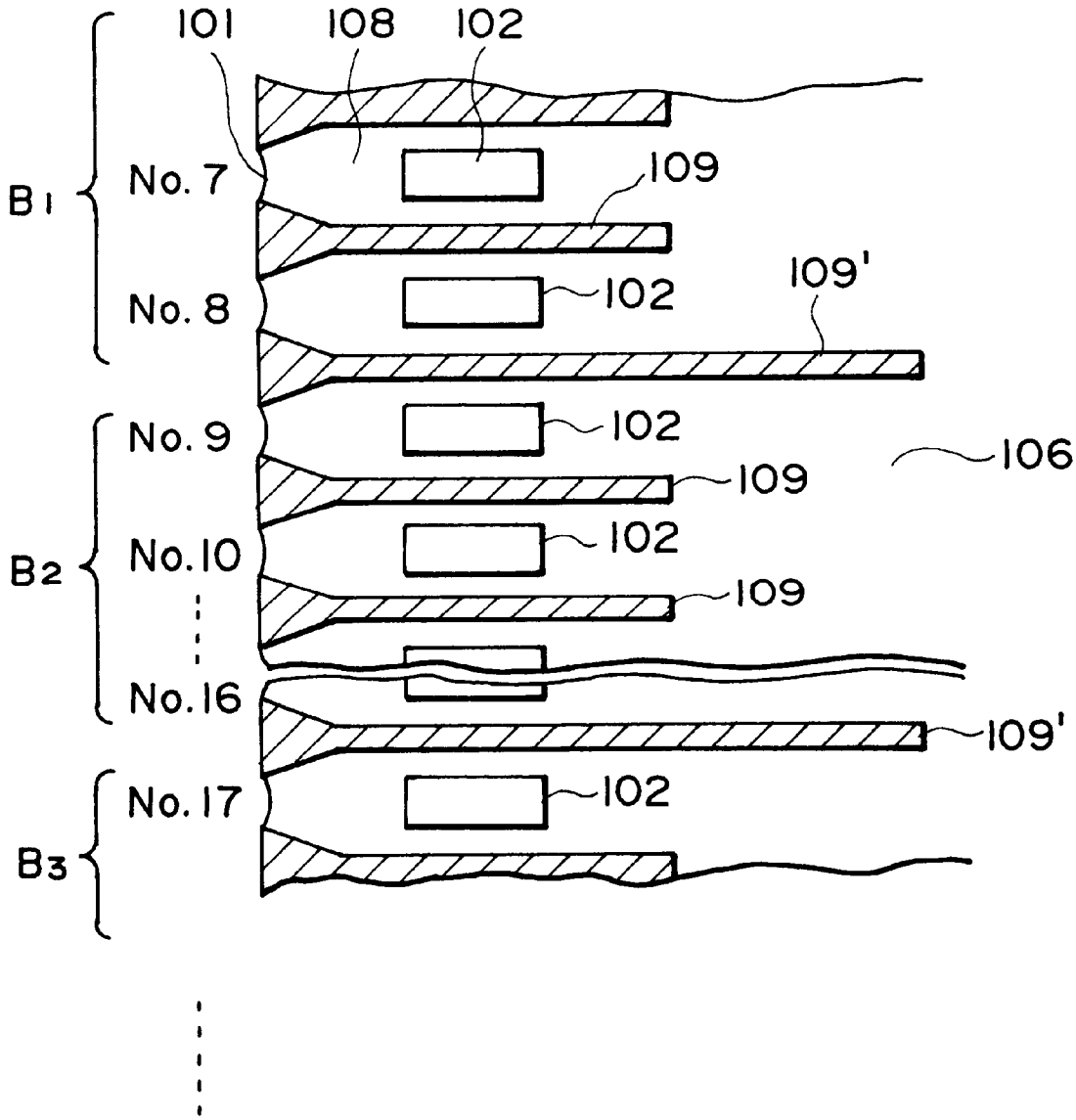
FIG. 3 is a sectional view of the ink jet head shown in FIG. 1, at a sectional line B—B.
Figure 4:
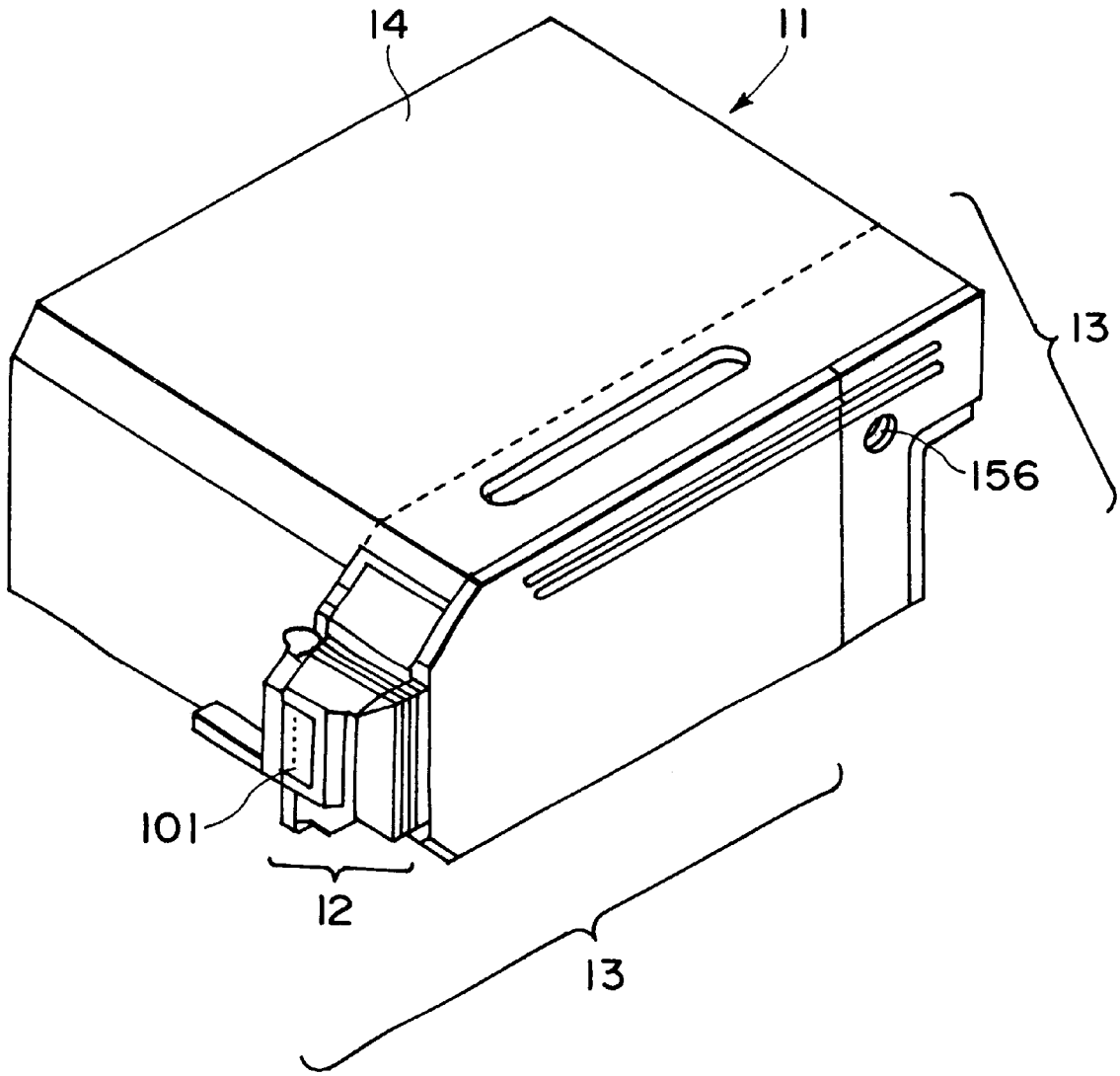
FIG. 4 is a perspective view of an ink jet cartridge incorporating the ink jet head shown in FIG. 1.

FIG. 1 is a schematic perspective view of the first embodiment of the ink jet head in accordance with the present invention. FIG. 2 is a sectional view of the ink jet head shown in FIG. 1, at a sectional line A—A. FIG. 3 is a sectional view of the ink jet head shown in FIG. 1, at a sectional line B—B. FIG. 4 is a perspective view of an ink jet cartridge incorporating the ink jet head shown in FIG. 1.

The ink jet cartridge 11 comprises an ink jet head 12 provided with a number of integrally formed ejection orifices 101, an ink jet unit 13 in which electric wiring and ink tubing for the ink jet head 12 are housed, and an ink container 14 which serves as an ink storing member, which are integrally assembled.

The ink jet cartridge 11 is of an exchangeable type, and is mounted on a carriage 16 (FIG. 8) of the main assembly of an ink jet apparatus 15, in a manner so as to be fixedly held by a positioning means and an electric contact, which will be described later.

First, the structure of the ink jet head 12 will be described.

As shown in FIGS. 1 to 3, the ink jet head 12 comprises electro-thermal transducers, which are placed as an energy generating element in ink passages 108 one for one, and generate thermal energy for ejecting recording liquid (ink) from two or more aligned ejection orifices 101 when a voltage is applied. As the driving signal is sent in, thermal energy is generated within the electro-thermal transducer 102, whereby the film boiling of the ink occurs, developing a bubble in the ink passage 108. As the bubble grows, the ink is ejected from the ejection orifice 101 as ink droplets. The electro-thermal transducer 102 is on a heater board 103, that is, silicon substrate, wherein the electro-thermal transducer 102 is integrally formed through film deposition technology, together with aluminum wiring (unshown) or the like for supplying the electro-thermal transducer 102 with electric power. Further, the ink jet head 12 comprises ink passage walls 109 or 109' which separate the ink passages 103 from each other, a grooved top plate 105 containing a common liquid chamber 106 for storing temporarily the ink to be supplied to each of the ink passages 108, an ink receiving port 107 through which the ink from the ink container 14 is introduced into the common liquid chamber 106, and an orifice plate 104 provided with two or more ejection orifices 101 which correspond one for one to ink passages 108, which are integrally assembled. As to material for these components, polyester is preferable, but other moldable resin material such as polyether sulfone, polyphenylene oxide, polypropylene, or the like, may be used.

Further, in this ink jet head 12, the ejection orifices 101 are grouped into two or more blocks, each of which comprises eight sequential orifices, and are separately driven. As for the liquid passage walls 109 and 109', the liquid passage walls 109', which constitute the borders between the blocks, are extended beyond the liquid passage walls 109, extending further rearward into the common liquid chamber 106.

Figure 5B:
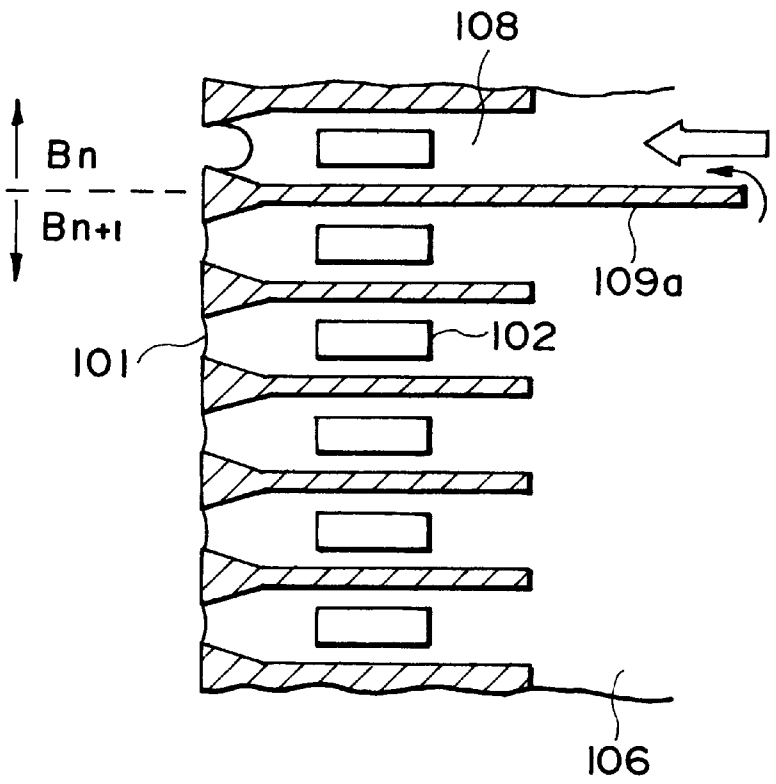
FIGS. 5A and 5B are sectional views of the ink head, depicting the state of the meniscus in the ink jet head in accordance with the present invention.

Next, referring to FIG. 5, the operation of the ink jet head 12 in this embodiment will be described in detail.

Figure 10:
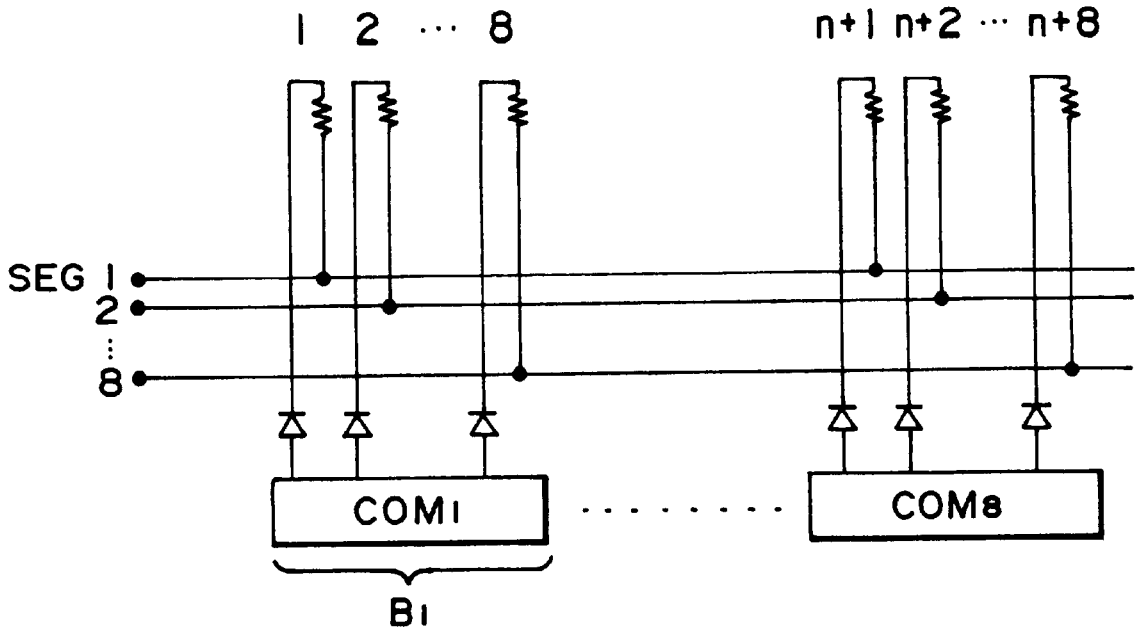
FIG. 10 PRIOR ART
FIG. 10 is a schematic drawing of an example of the driver circuit for the ink jet head.
Figure 11:
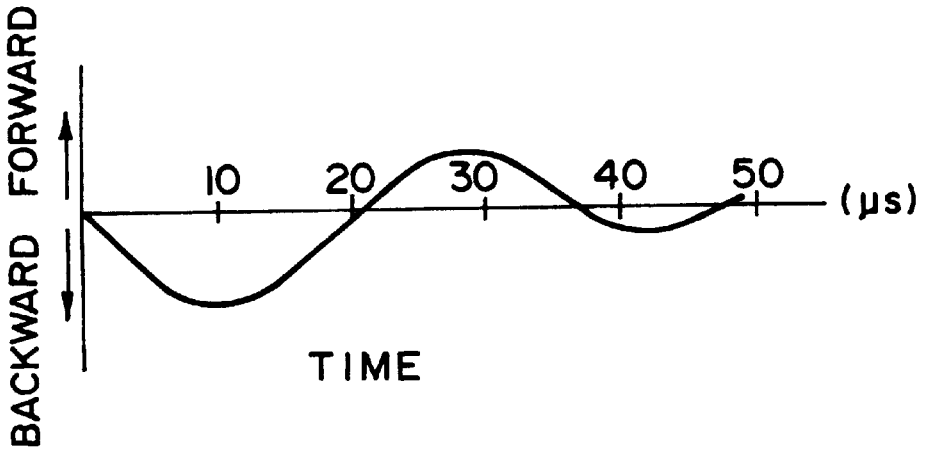
FIG. 11 PRIOR ART
FIG. 11 is a graph showing the relation between the elapsed time after one of the blocks is driven in the ink jet head shown in FIG. 9, and the magnitude of the meniscus vibration in the adjacent blocks.
Figure 12:
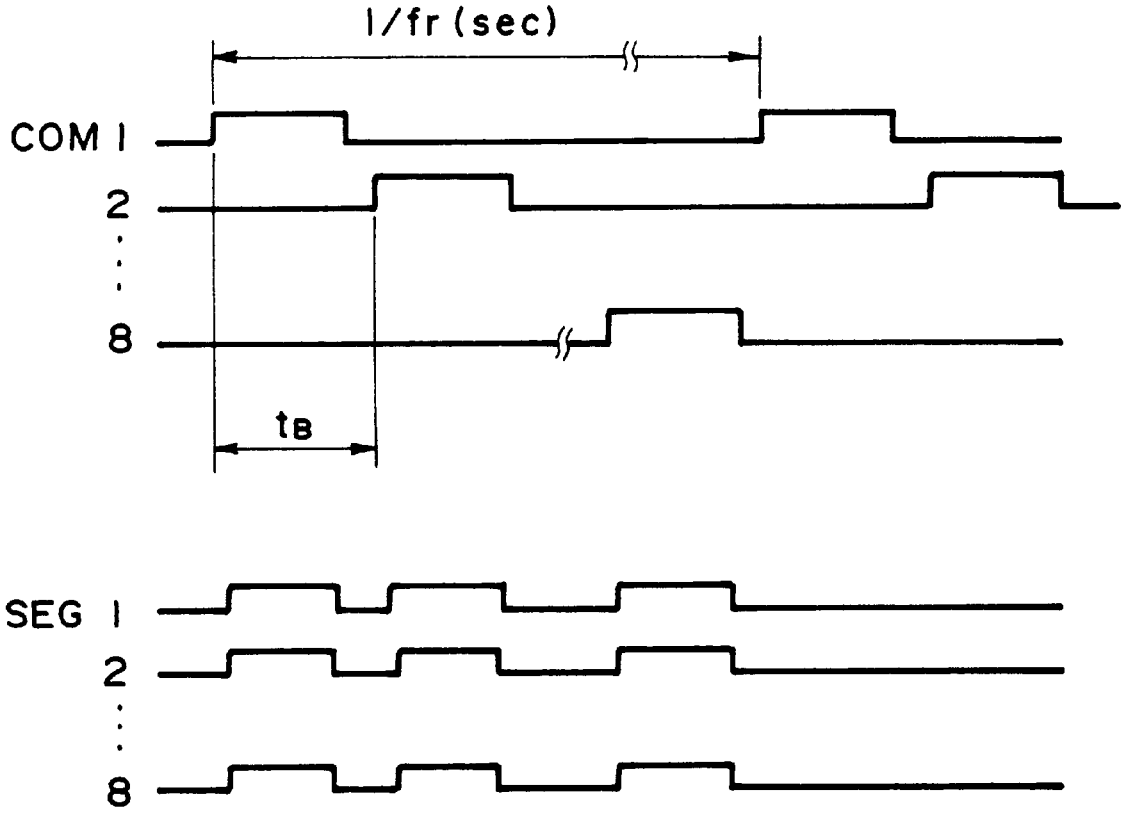
FIG. 12 PRIOR ART
FIG. 12 is a timing chart showing the inter-block relation of the driving timing.
Figure 13B:
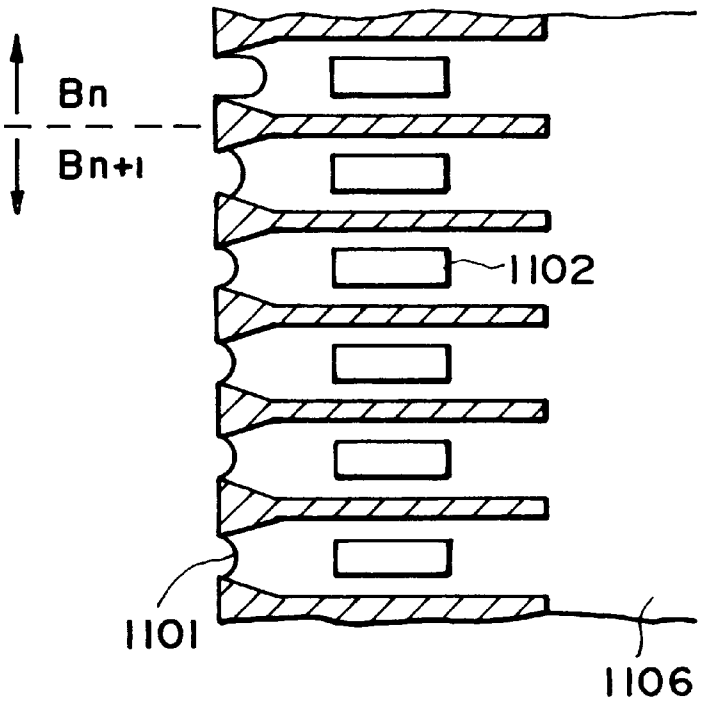
FIG. 13B PRIOR ART
FIGS. 13A and 13B are sectional views of the ink jet head shown in FIG. 9, depicting the meniscus state.
Figure 13A:
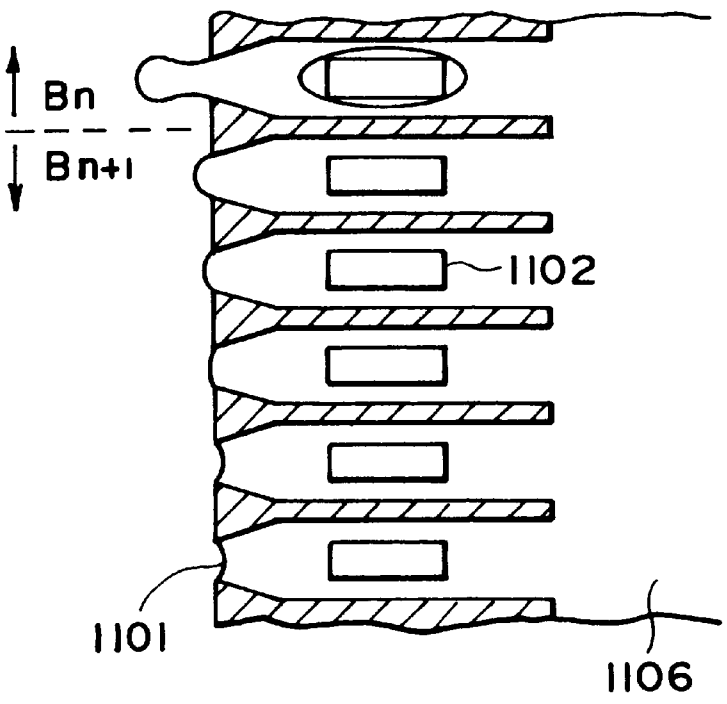
FIG. 13A PRIOR ART
Figure 14:
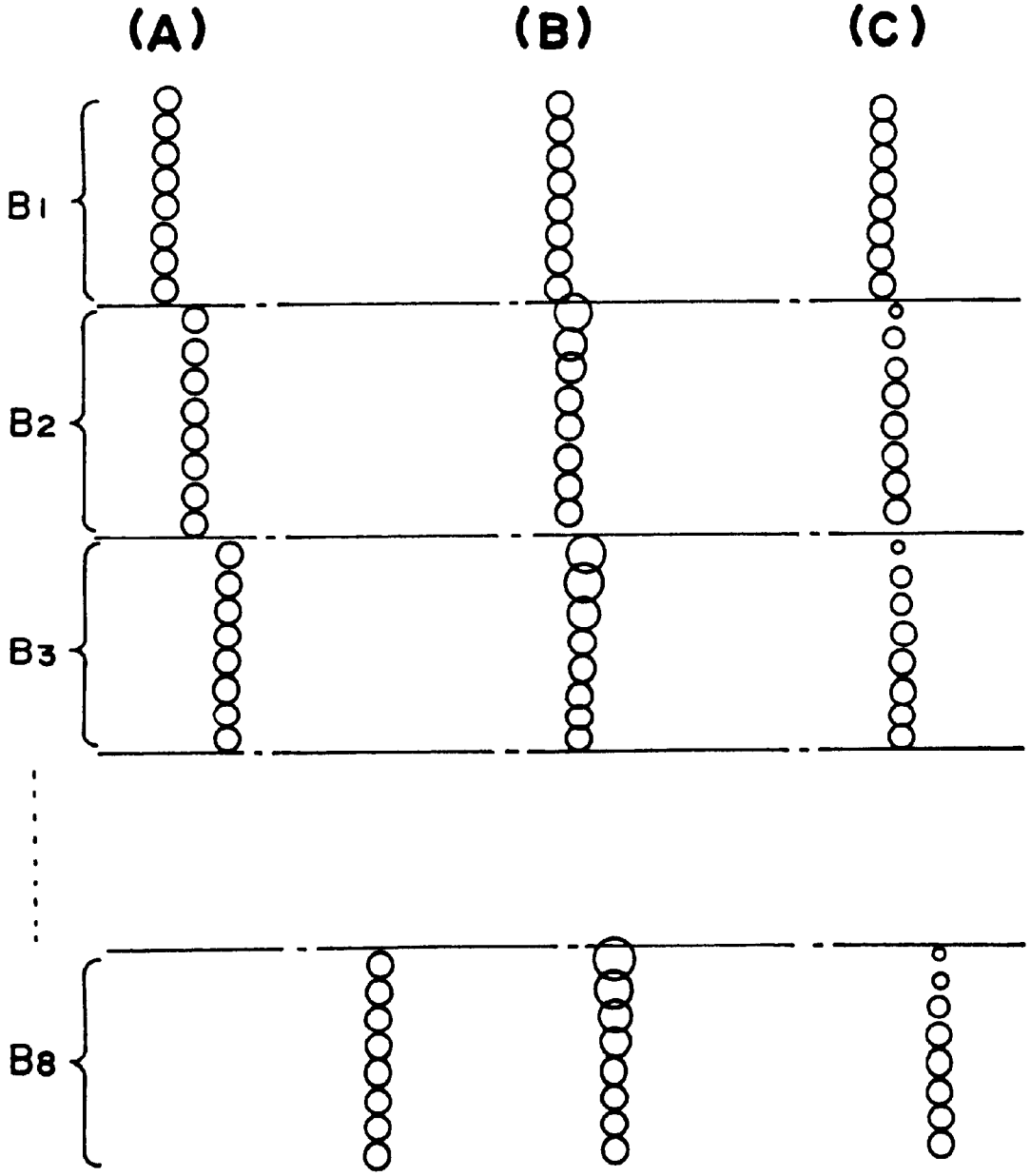
FIG. 14 PRIOR ART
FIG. 14 is a schematic drawing illustrating print examples: dot diameter within the same block is substantially the same (A); dot diameter in the same block gradually decreases (B); dot diameter in the same block gradually increases (C).

FIG. 5 illustrates the state of the meniscus in the ink jet head shown in FIGS. 1 to 3: (A) state in which a bubble is growing, and (B) state immediately after the bubble collapses. In this embodiment, the energy generating elements are driven by the block, wherein the circuit structure is the same as that shown in FIG. 10.

Figure 5A:
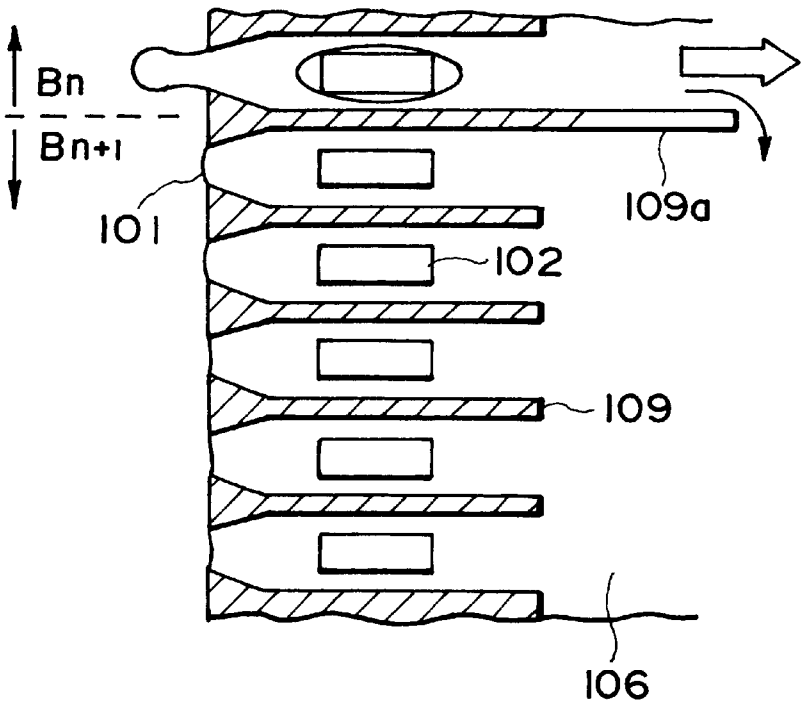

In this case, when one of the electro-thermal transducers 10 in the preceding block is driven as shown in FIG. 5(A), a bubble is formed in the ink on this electro-thermal transducer 102, and grows. At this moment, the ink present on the common liquid chamber 106 side of this electro-thermal transducer 102 is pushed back toward the common liquid chamber 106, as shown by an arrow. Now that the liquid passage wall 109*a* constituting the border between this block and the following block is extended beyond the other liquid passage walls 109 further into the common liquid chamber 106, the movement of the ink pushed back is impeded by the liquid passage wall 109*a* separating this block from the adjacent blocks, whereby hardly any ink moves into the region of the common liquid chamber, which corresponds to the adjacent block. Therefore, substantially uniform meniscuses are formed at the ejection orifices of the block to be next driven. Now, referring to FIG. 5(B), after one of the electro-thermal transducers 102 in the preceding block is driven, the bubble on this electro-thermal transducer 102 collapses, whereby the ink is drawn into the ink passage 108 from the common liquid chamber 106. At this moment, the ink is hardly drawn from the region of the common liquid chamber 106, which corresponds to the following block, because of the same reason as was given in the foregoing. Therefore, substantially uniform meniscuses can be formed at the ejection orifices 101 of the block to be next driven. In other words, when the electro-thermal transducers are driven in the preceding block, the ink vibration triggered in the ink passage in the preceding block is not likely to propagate into the ink passages 108 of the following block, whereby the meniscus vibration becomes unlikely to occur in the following block. As a result, when the following block is driven, the amount of the ink ejected from each of the ejection orifices of the following block is stabilized, producing on a recording medium an excellent print composed of dots having substantially the same diameter.

Figure 6:
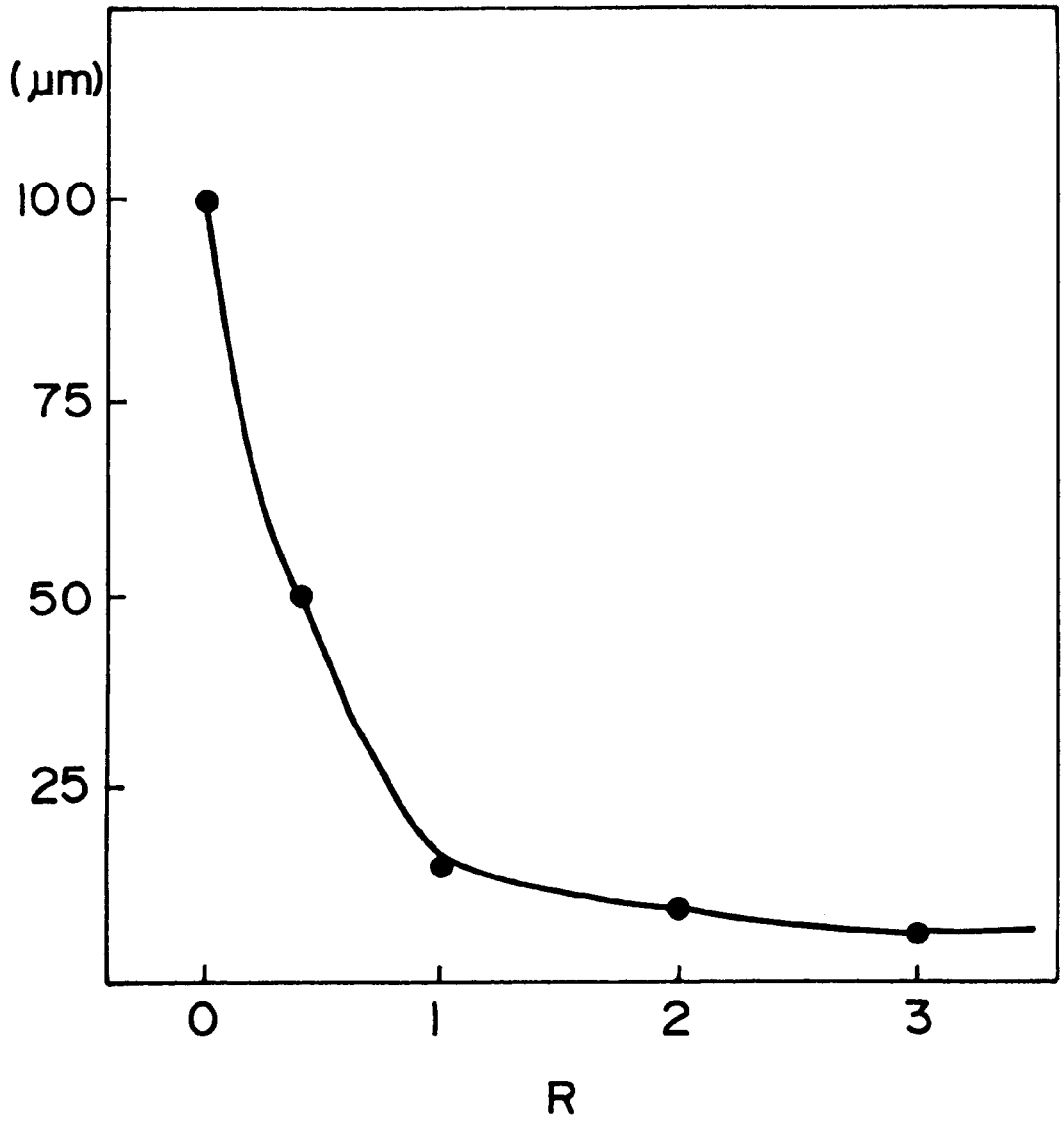
FIG. 6 is a graph showing the relation between the length of the liquid wall extension and the magnitude of the meniscus vibration.

FIG. 6 presents the results of the experiment conducted with regard to the relation between the above described effects and the magnitude of the meniscus vibration. FIG. 6 is a graph depicting the relation between the ratio of the length of the extended portion of the liquid passage wall to the length of the electro-thermal transducer (axis of abscissa), and the magnitude of the meniscus vibration (axis of ordinate). Here, the ratio of the extended portion of the liquid passage wall to the length of the electro-thermal transducer is expressed as follows:

{(length of the liquid passage wall 109*a* constituting the block border)−(length of other liquid passage wall 109)}/(length of electro-thermal transducer)

This graph reveals that when the liquid passage wall constituting the block border is longer than the other liquid passage wall by one half the length of the electro-thermal transducer, the magnitude of the meniscus vibration is suppressed to a level equal to one half the magnitude when the value of the ratio of the extended portion of the liquid passage wall is zero, that is, when all of the liquid passage walls have the same length. Further, when the length of the liquid passage wall constituting the block border is extended longer than other liquid passage walls by a length substantially equal to the length of the electro-thermal transducer, the magnitude of the meniscus vibration is suppressed to one quarter, bringing forth larger effects. Therefore, it is preferable that the length of the liquid passage wall constituting the block border be longer than other liquid passage walls by a length longer than the length of the electro-thermal transducer.

Figure 7:
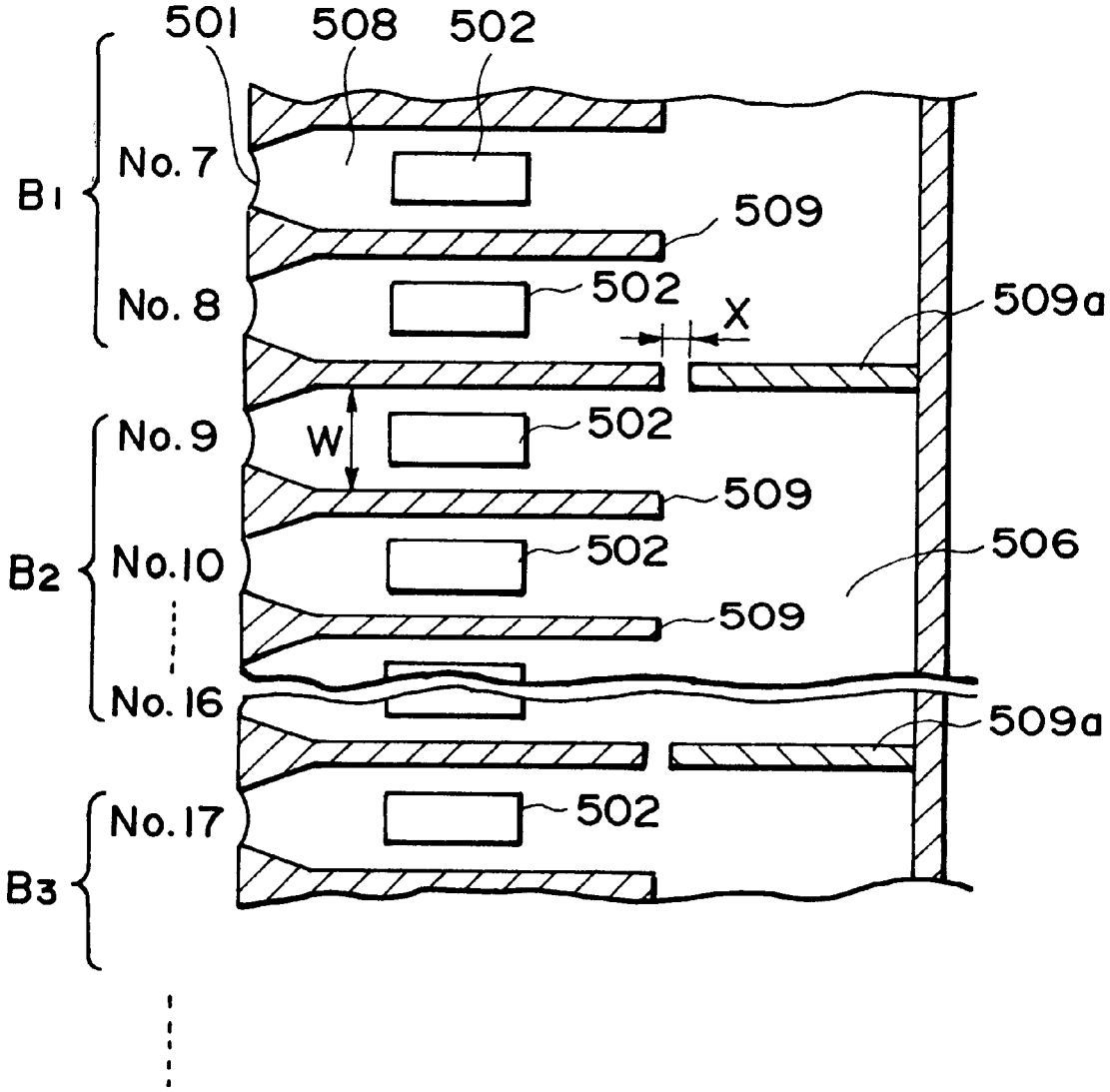
FIG. 7 is a schematic sectional view of an alternative embodiment of the ink jet head in accordance with the present invention.

Next, the second embodiment of the present invention will be described. FIG. 7 is a sectional partial view of the second embodiment of the ink jet head in accordance with the present invention, wherein the ink jet head is sectioned at a sectional line equivalent to the sectional line B—B in FIG. 1, to expose the liquid passages. This embodiment of the ink jet head is different from the first embodiment of the ink jet head shown in FIG. 3, in that in addition to the aforementioned liquid passage walls 509, liquid passage walls 509*a* are integrally formed on the top plate (unshown), wherein the liquid passage walls 509*a* are formed in a manner to serve as continuations of the liquid passage walls 509 constituting the block border, with a gap of X between the tips of two walls. The structures of other components such as ejection orifices 501, electro-thermal transducers 502, ink passages 508, common liquid chamber 506, and the like are the same as those in the first embodiment; therefore, their descriptions will be omitted.

When the second liquid passage walls 509*a* holding the gap X from the liquid passage wall 509 are provided as described in the foregoing, the ink in the common liquid chamber behaves in substantially the same manner as in the first embodiment, stabilizing the meniscus at each of the ejection orifices. This embodiment is effective when the liquid passage walls cannot be extended toward the common liquid chamber 506 because of the structure of the metallic mold or the like. However, in this embodiment, if the gap X between the liquid passage wall 509 and the liquid passage wall 509*a* is excessive, the above described effects cannot be sufficiently displayed; if, on the contrary, the gap X is too small, it creates a problem in the ink jet head production. Therefore, it is preferable that the size of the gap X is not more than one half of a width W of the ink passage 508. Further, the length of the liquid passage wall 509*a* is equivalent to (length of liquid passage wall constituting block border–length of other liquid passage wall). The relation between the ratio of the second liquid passage wall 509*a* to the length of the electro-thermal transducer 502, and the magnitude of the meniscus vibration, is the same as that shown in FIG. 6. In this embodiment, the gap X is provided between the liquid passage wall 509 and the second liquid passage wall 509*a;* therefore, the second liquid passage wall 509*a* may be extended to the maximum. In other words, the end opposite to the liquid passage wall 509 may be extended to the rear wall of the common liquid chamber 506 (right side wall in the drawing).

In the embodiments described in the foregoing, the liquid passages are formed on the top plate, but the design is not limited to this particular design. For example, the second liquid passage wall formed as a continuation of the first liquid passage wall may be formed of photosensitive resin or the like, on the heater board, using photolithography or like technology. The results will be the same. As for grouping of the ejection orifices into blocks, eight ejection orifices are grouped into a single block in this embodiment, but the number of ejection orifices may be increased or decreased as needed.

Further, in the embodiments described in the foregoing, the heat generating element (electro-thermal transducer) was employed as the element for generating energy for ejecting the ink, but the present invention is also applicable to an ink jet head in which a piezo-electric element is adopted as the element for generating the ejection energy.

However, in the ink jet head in which the electro-thermal element is used to induce the film boiling, not only the pressure wave generated when the bubble develops, but also, the shock wave or the like generated when the bubble collapses, are impeded from propagating through the ink into the liquid passage of the adjacent blocks, which amplifies the effects of the present invention.

Next, the outline of an ink jet apparatus 15 in accordance with present invention will be given.

Figure 8:
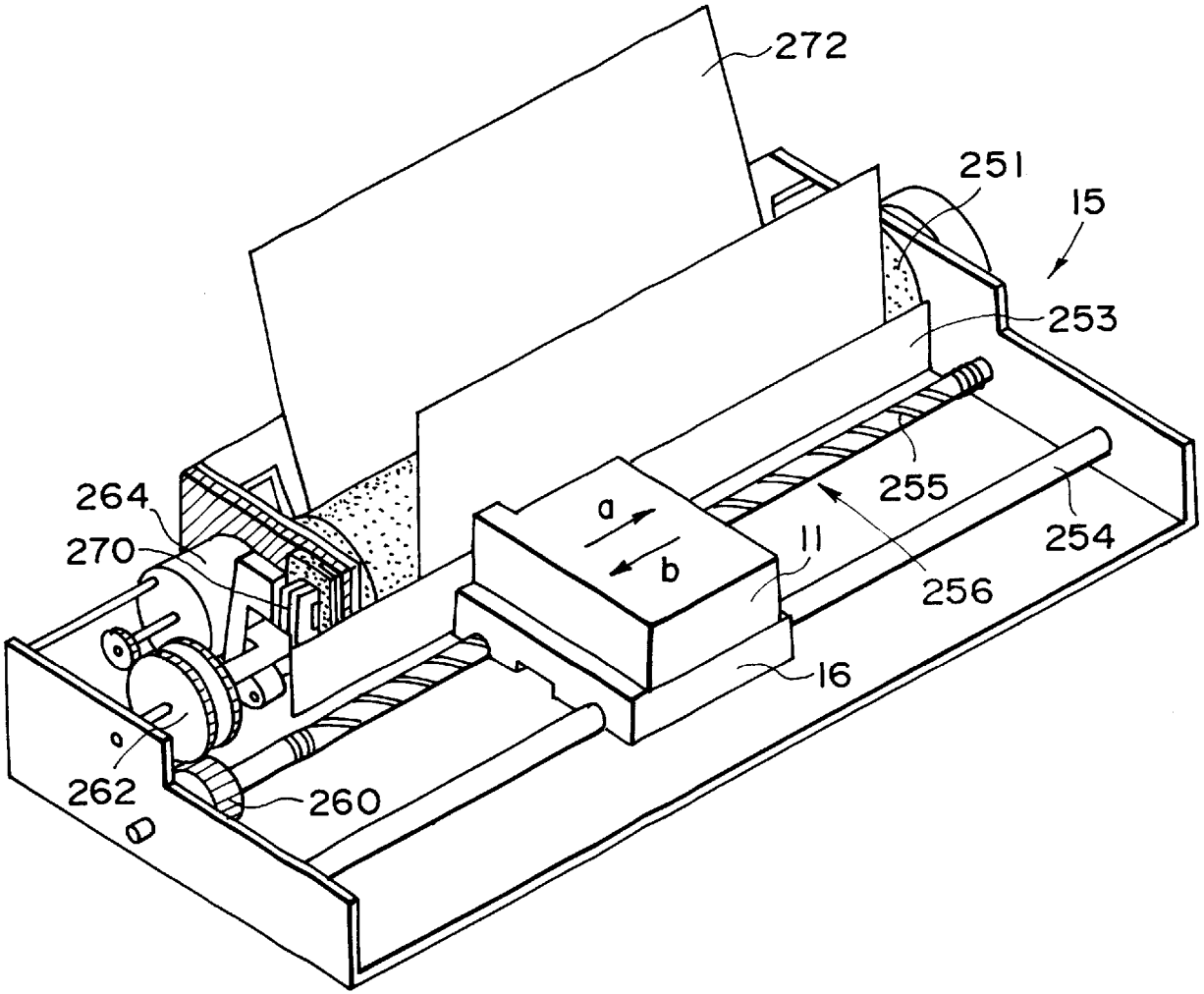
FIG. 8 is a perspective view of the ink jet apparatus in accordance with the present invention.
Figure 9:
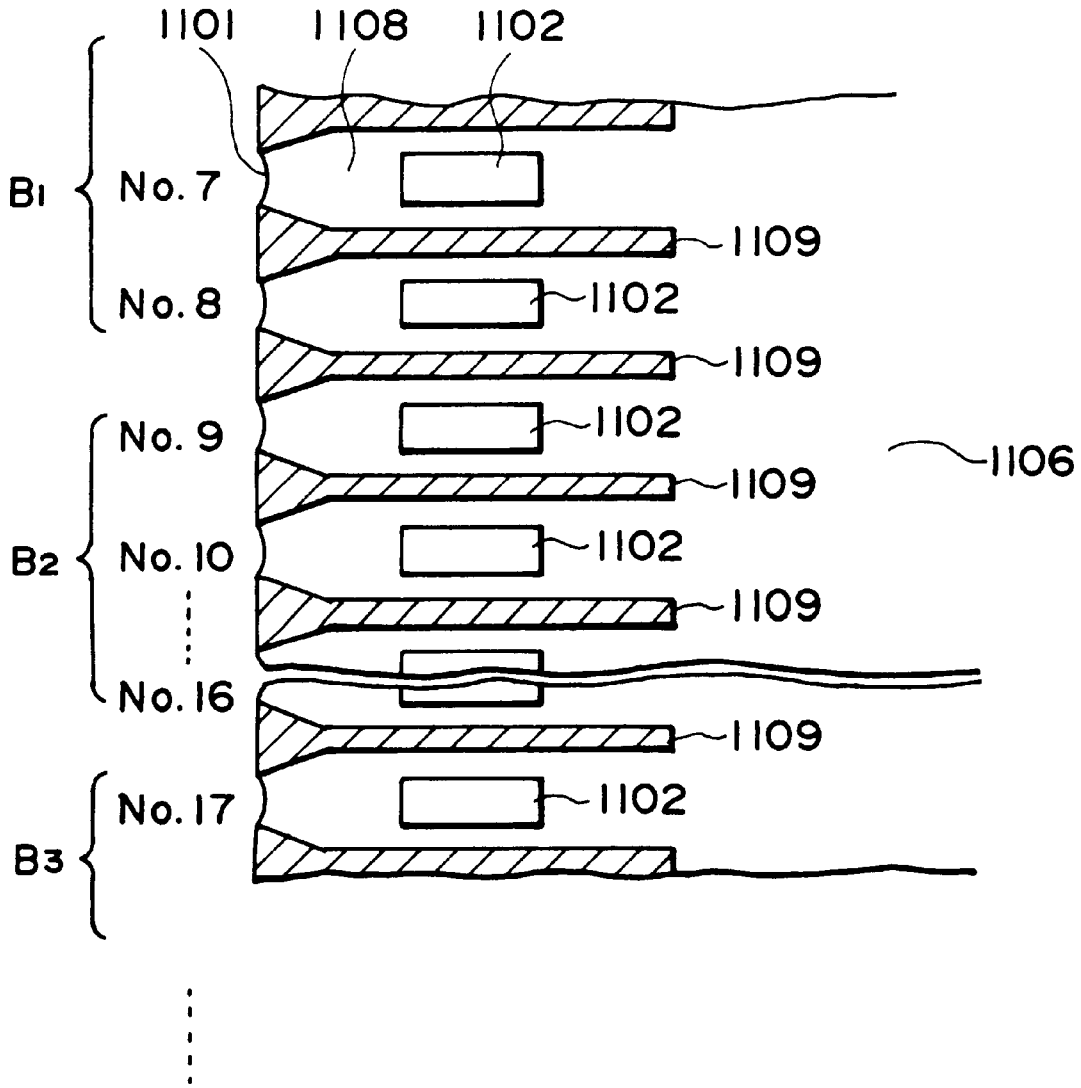
FIG. 9 PRIOR ART
FIG. 9 is a sectional partial view of a conventional ink jet head, being sectioned to expose the liquid passages.

The outline of the ink jet apparatus to which the present invention is applicable is shown in FIG. 8. A lead screw 256 on which a spiral groove is cut is rotated forward or backward by a driving motor 264, through driving force transmission gears 262 and 260. A carriage 16 is meshed with the spiral groove 255, and also is engaged with a guide rail 254 on which it slides, whereby the carriage 16 is enabled to shuttle in the direction indicated by arrows a and b. A sheet holding plate 253 presses a recording medium 272 on a platen roller 251 across the recording medium width in the shuttling direction of the carriage 16. A capping member 270 for capping the front face of the ink jet head 12 is provided for sucking the ink jet head 12 to restore its performance.

Further, this apparatus comprises a means for supplying a signal to driving the ink jet head.

In this apparatus, an image is recorded on the recording medium by scanning the recording medium by the ink jet head mounted on the carriage.

However, the present invention is also applicable to an apparatus incorporating a so-called full-line type ink jet head, the ink jet head comprising a large number of aligned ejection orifices, that is, large enough to cover the full recordable width of the recording medium. In the full-line type ink jet head, it is easier for the pressure wave in the ink to propagate into the adjacent blocks, through the common liquid chamber; therefore, the full-line type ink head is a more preferable candidate to which the present invention is applicable.

Further, the application of the present invention is not limited to the aforementioned ink jet apparatus; the present invention is also applicable, with preferable results, to a facsimile apparatus, textile printing apparatus for which fabric is the recording medium, an apparatus for pre-treating or post-treating the fabric, or the like apparatus.

As was described in the foregoing, the ink jet head according to the present invention comprises extended portions extending into the common liquid chamber, being formed at least as continuation of the liquid passage walls constituting the block borders; whereby the effects of the ink vibration generated when the preceding block is driven are reduced, allowing the ink to be ejected while the meniscus is stable. As a result, an excellent print quality can be obtained in which the dots have substantially the same diameter.

Further, when it is impossible to form integrally the liquid passage walls and the extended portions, the extended portions may be positioned to hold a predetermined gap from the liquid passage walls constituting the block borders; this arrangement offers the same effects as the first arrangement.

What is claimed is:

1. An ink jet head comprising:

a plurality of ejection orifices for ejecting ink;

a common liquid chamber for storing temporarily the ink to be supplied to each of said ejection orifices;

a plurality of ink passages, separated by respective liquid passage walls each having a predetermined length and connecting said ejection orifices to said common liquid chamber; and a plurality of energy generating elements each provided on a substrate, corresponding to each of said ink passages for generating energy to eject the ink from each of said ejection orifices;

wherein said ejection orifices are grouped into a plurality of blocks comprising a plurality of said ejection orifices in sequence so that said energy generating elements are driven by the block; and an impeding wall for impeding propagation of pressure, produced by driving a block of energy generating elements, to an adjacent block, said impeding wall being provided in said common liquid chamber, corresponding to a dividing line between adjacent blocks, wherein said impeding wall is provided integrally with a grooved member which has a liquid chamber wall for constituting said common liquid chamber and said liquid passage walls, and said ink jet head is constituted by connecting the grooved member and said substrate.

2. An ink jet head according to claim 1, wherein said impeding wall provided in said common liquid chamber is a wall that holds a predetermined distance from said liquid passage walls constituting the dividing lines between the adjacent blocks.

3. An ink jet head according to claim 1, wherein said impeding wall is an extension of a wall that defines said ink passages.

4. An ink jet head according to claim 1, wherein said impeding wall narrows a width of said common liquid chamber at a portion along said dividing lines.

5. An ink jet head according to claim 1, wherein said impeding wall provided in said common liquid chamber is an extension of a given one of said liquid passage walls constituting the dividing lines between the blocks, extending into said common liquid chamber.

6. An ink jet head according to claim 5 or 2, wherein a length of said impeding wall provided in said common liquid chamber is not less than one half of the length of said energy generating elements.

7. An ink jet head according to claim 5 or 2, wherein a length of said impeding wall provided in said common liquid chamber is not less than the length of said energy generating elements.

8. An ink jet head according to claim 5 or 2, wherein said energy generating elements are electro-thermal transducers for generating thermal energy.

9. An ink jet head according to claim 8, wherein the thermal energy generated by said electro-thermal transducers induce film boiling of the ink, which in turn ejects the ink from each of said ejection orifices.

10. An ink jet cartridge comprising:

an ink jet head comprising;

a plurality of ejection orifices for ejecting ink; a common liquid chamber for storing temporarily the ink to be supplied to each of said ejection orifices;

a plurality of ink passages, separated by respective liquid passage walls each having a predetermined length and connecting said ejection orifices to said common liquid chamber; and a plurality of energy generating elements each provided on a substrate, corresponding to each of said ink passages for generating energy to eject the ink from each of said ejection orifices;

wherein said ejection orifices are grouped into a plurality of blocks comprising a plurality of said ejection orifices in sequence so that said energy generating elements are driven by the block; and an impeding wall for impeding propagation of pressure, produced by driving a block of energy generating elements, to an adjacent block, said impeding wall being provided in said common liquid chamber, corresponding to a dividing line between adjacent blocks, wherein said impeding wall is provided integrally with a grooved member which has a liquid chamber wall for constituting said common liquid chamber and said liquid passage walls, and said ink jet head is constituted by connecting the grooved member and said substrate; and an ink container for storing the ink to be supplied to said ink jet recording head.

11. An ink jet cartridge according to claim 10, wherein said impeding wall is an extension of a wall that defines said ink passages.

12. An ink jet cartridge according to claim 10, wherein said impeding wall narrows a width of said common liquid chamber at a portion along said dividing lines.

13. An ink jet cartridge according to claim 12, wherein said impeding wall provided in said common liquid chamber is a wall that holds a predetermined distance from said liquid passage walls constituting the dividing lines between the adjacent blocks.

14. An ink jet cartridge according to claim 12, wherein said impeding wall provided in said common liquid chamber is an extension of a given one of said liquid passage wall constituting the dividing lines between the adjacent blocks, extending into said common liquid chamber.

15. An ink jet cartridge according to claim 14 or 13, wherein a length of said impeding wall provided in said common liquid chamber is not less than one half of a length of said energy generating elements.

16. An ink jet head according to claim 14 or 13, wherein a length of said impeding wall provided in said common liquid chamber is not less than a length of said energy generating elements.

17. An ink jet cartridge according to claim 14 or 13, wherein the said energy generating elements are electro-thermal transducers for generating thermal energy.

18. An ink jet apparatus which effects recording by ejecting ink, comprising:

an ink jet head comprising;

a plurality of ejection orifices for ejecting ink;

a common liquid chamber for storing temporarily the ink to be supplied to each of said ejection orifices, the common liquid chamber having a plurality of walls;

a plurality of ink passages, separated by respective liquid passage walls each having a predetermined length and connecting said ejection orifices to said common liquid chamber; and a plurality of energy generating elements each provided on a substrate, corresponding to each of said ink passages for generating energy to eject the ink from each of said ejection orifices;

wherein said ejection orifices are grouped into a plurality of control blocks comprising a plurality of said ejection orifices in sequence so that said energy generating elements are driven by the block; and an impeding wall for impeding propagation of pressure, produced by driving a block of energy generating elements, to an adjacent block, said impeding wall being provided in said common liquid chamber, corresponding to a dividing line between adjacent blocks, wherein said impeding wall is provided integrally with a grooved member which has a liquid chamber wall for constituting said common liquid chamber and said liquid passage walls, and said ink jet head is constituted by connecting the grooved member and said substrate.

19. An apparatus according to claim 18, wherein said impeding wall is an extension of a wall that defines said ink passages.

20. An ink jet apparatus according to claim 18, wherein said impeding wall narrows a width of said common liquid chamber at a portion along said dividing lines.

21. An ink jet apparatus according to claim 20, wherein said impeding wall provided in said common liquid chamber is a wall that holds a predetermined distance from said liquid passage walls constituting the dividing lines between the adjacent blocks.

22. An ink jet cartridge according to claim 20, wherein said impeding wall provided in said common liquid chamber is an extension of a given one of said liquid passage walls constituting the dividing lines between the adjacent blocks, extending into said common liquid chamber.

23. An ink jet apparatus according to claim 22 or 21, wherein a length of said impeding wall provided in said common liquid chamber is not less than one half of a length of said energy generating elements.

24. An ink jet apparatus according to claim 22 or 21, wherein a length of said impeding wall provided in said common liquid chamber is not less than a length of said energy generating elements.

25. An ink jet apparatus according to claim 22 or 21, wherein the said energy generating elements are an electro-thermal transducers for generating thermal energy.

* * * * *

UNITED STATES PATENT AND TRADEMARK OFFICE

CERTIFICATE OF CORRECTION

PATENT NO. : 6,048,058
DATED : April 11, 2000
INVENTOR(S) : Masami Kasamoto et al.

It is certified that error appears in the above-identified patent and that said Letters Patent is hereby corrected as shown below:

Title page,
Item [54], "INCORPORATING INK JET" should read -- INCORPORATING INK JET HEAD --.

Column 1,
Line 2, "INCORPORATING INK JET" should read -- INCORPORATING INK JET HEAD --.

Column 10,
Line 63, "an" should be deleted.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*